US007283026B2

(12) United States Patent
Nakamura et al.

(10) Patent No.: US 7,283,026 B2
(45) Date of Patent: Oct. 16, 2007

(54) ELECTROMAGNETIC RELAY

(75) Inventors: Akihiko Nakamura, Shinagawa (JP); Shigemitsu Aoki, Shinagawa (JP); Hirofumi Saso, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 104 days.

(21) Appl. No.: 11/341,589

(22) Filed: Jan. 30, 2006

(65) Prior Publication Data

US 2006/0181380 A1 Aug. 17, 2006

(30) Foreign Application Priority Data

Jan. 31, 2005 (JP) ..... 2005-024256

(51) Int. Cl.
*H01F 51/22* (2006.01)

(52) U.S. Cl. ..... 335/78; 335/86; 335/202

(58) Field of Classification Search ..... 335/78–86, 335/202

See application file for complete search history.

(56) References Cited

U.S. PATENT DOCUMENTS 4,658,226 A * 4/1987 Maenishi et al. ..... 335/127
4,713,638 A * 12/1987 Kamo et al. ..... 335/79
4,812,794 A * 3/1989 Asbell et al. ..... 335/151
5,202,663 A * 4/1993 Tomono et al. ..... 335/86
5,757,255 A * 5/1998 Noda et al. ..... 335/78
5,889,451 A * 3/1999 Kern ..... 335/78
5,969,586 A * 10/1999 Noda et al. ..... 335/83
6,448,877 B1 * 9/2002 Harayama et al. ..... 335/78
6,621,394 B2 * 9/2003 Ono et al. ..... 335/159
7,046,107 B2 * 5/2006 Yamamoto et al. ..... 335/128

FOREIGN PATENT DOCUMENTS

JP 10-3841 1/1998
JP 2002-100275 4/2002

* cited by examiner

*Primary Examiner*—Ramon M. Barrera
(74) *Attorney, Agent, or Firm*—Staas & Halsey LLP

(57) ABSTRACT

An electromagnetic relay including a base, an electromagnet fitted to the base, and a contact section operable to open or close with an operation of the electromagnet. The base includes a retaining face firstly contacting with the yoke of the electromagnet, in an action of fitting the electromagnet to the base, and retaining the electromagnet at a predetermined height on the base as seen in a direction of the coil center axis of the electromagnet. The base also includes a guide face slidably engaged with the yoke, by shifting the yoke along the retaining face, and guiding the electromagnet in a fitting direction intersecting with the coil center axis. The retaining face and the guide face cooperate with each other to fixedly support the electromagnet at a predetermined fitting position on the base.

12 Claims, 12 Drawing Sheets

ELECTROMAGNETIC RELAY

BACKGROUND OF THE INVENTION

1. Field of the Invention

The present invention relates to an electromagnetic relay.

2. Description of the Related Art

Conventionally, in an electromagnetic relay used for applications in which a number of circuit components should be arranged in a limited space, such as applications for vehicle-mounted electric appliances or audio equipment, it is required to inhibit an increase in the manufacturing cost and to facilitate miniaturization. In this type of electromagnetic relay, as the outer dimensions thereof are further reduced, it tends to be difficult to assemble components, such as an electromagnet, a contact section, etc., with a high positional accuracy.

For example, Japanese Unexamined Patent Publication (Kokai) No. 2002-100275 (JP-A-2002-100275) discloses an electromagnetic relay in which an electromagnet (including a coil, a bobbin, an iron core and a yoke) and a contact section (including a stationary contact and a movable contact) operable to open or close with an operation of the electromagnet are fitted to a common base, and in which a stationary contact member having the stationary contact is fixedly supported on the base and a movable contact-spring member having the movable contact is supported on the electromagnet in an elastically displaceable manner. In this configuration, the fitting accuracy of the electromagnet with respect to the base affects a positional correlation between the stationary contact and the movable contact. More specifically, if the position of the electromagnet deviates on the base, the movable contact deviates from a proper position relatively to the stationary contact and, as a result, the operational characteristics of the electromagnetic relay may become unstable. Therefore, for example, in the electromagnetic relay as set forth in JP-A-2002-100275, a leg formed on the bobbin of the electromagnet is inserted into a hole formed in the base and a catch formed at the distal end of the leg is engaged with the bottom face of the base and, thereby, the electromagnet is fixed at a predetermined position on the base.

On the other hand, Japanese Unexamined Patent Publication (Kokai) No. 10-3841 (JP-A-10-3841) discloses an electromagnetic relay having the common base described above, in which not only the stationary contact member but also the movable contact-spring member is supported on the base. This configuration typically uses a transmission member (referred to as, e.g., a card) for transmitting the operation of the electromagnet to the movable contact-spring member. In this configuration, if the position of the electromagnet deviates on the base, a positional correlation between the transmission member and the movable contact-spring member is changed and, as a result, the operational characteristics of the electromagnetic relay may also become unstable. Therefore, for example, in the electromagnetic relay as set forth in JP-A-10-3841, a support section is formed on the base to fixedly support, in an engaging manner, the yoke of the electromagnet at a predetermined position. The support section is provided with a guide groove for slidably receiving the outer periphery of the yoke and a slit for holding a local projection formed on the outer periphery of the yoke under elastic pressing force. In an action of fitting the electromagnet to the base, the guide groove of the support section is slidably engaged with the outer periphery of the yoke so as to guide the electromagnet in a fitting direction parallel to a coil center axis.

In the electromagnetic relay as set forth in JP-A-2002-100275, the leg formed on the bobbin of the electromagnet is inserted into the hole formed in the base, so that the electromagnet is fixed at the predetermined position on the base. In this configuration, as the electromagnetic relay is further miniaturized, it tends to become difficult to insert the leg of the bobbin into the hole of the base. Moreover, in order to ensure the positional fitting accuracy of the electromagnet with respect to the base, it is necessary to improve the molding dimensional accuracy of the small-sized leg and hole, which may result in an increased manufacturing cost.

On the other hand, in the electromagnetic relay as set forth in JP-A-10-3841, the outer periphery of the yoke of the electromagnet is inserted into the guide groove formed in the support section of the base, so that the electromagnet is fixed at the predetermined position on the base. In this configuration, as the electromagnetic relay is further miniaturized, it tends to become difficult to insert the outer periphery of the yoke into the guide groove of the support section. In particular, due to the fact that the positional fitting accuracy of the electromagnet with respect to the base is ensured by the slit of the support section holding the local projection of the yoke under an elastic pressing force, the positional deviation of the electromagnet may occur if an external force larger than the elastic pressing force is applied to the electromagnet. Further, the configuration having the card exhibits a poor continuous-current performance (e.g., of 25 A) required for a vehicle-mounted application and thus is not suitable for a vehicle-mounted use.

SUMMARY OF THE INVENTION

It is an object of the present invention to provide an electromagnetic relay with an electromagnet and a contact section being fitted to a common base, which meets a requirement for miniaturization, and which can be easily assembled, with a high positional accuracy, while inhibiting an increase in the manufacturing cost.

To accomplish the above object, the present invention provides an electromagnetic relay comprising a base; an electromagnet fitted to the base; and a contact section fitted to the base and operable to open or close with an operation of the electromagnet; wherein the electromagnet includes a bobbin; a coil having a center axis and wound and supported on the bobbin; an iron core incorporated into the bobbin and disposed along the center axis of the coil; and a yoke extending from the iron core to an outside of the bobbin and the coil; wherein the base includes a retaining face firstly contacting with at least one of the yoke and the bobbin, in an action of fitting the electromagnet to the base, and retaining the electromagnet at a predetermined height on the base as seen in a direction of the center axis of the coil; and a guide face slidably engaged with at least one of the yoke and the bobbin, by shifting at least one of the yoke and the bobbin along the retaining face, and guiding the electromagnet in a fitting direction intersecting with the center axis; the retaining face and the guide face cooperating with each other to fixedly support the electromagnet at a predetermined fitting position on the base.

In the above electromagnetic relay, the base may be provided with a groove defined between the retaining face and the guide face, the groove straightly extending in the fitting direction and slidably receiving at least one of an outer periphery of the yoke and an outer periphery of the bobbin.

The electromagnet may further include a coil terminal carried on the bobbin, the coil terminal being provided with a lead portion extending generally parallel to the center axis of the coil and projecting outside of the base; and the base may include a through hole receiving the lead portion of the coil terminal, the through hole being shaped to receive the lead portion by shifting the electromagnet relatively to the base in a direction intersecting with the fitting direction and to permit the electromagnet to be shifted in the fitting direction with the lead portion received in the through hole, during the action of fitting the electromagnet to the base.

Also, the electromagnet may further include a coil terminal carried on the bobbin, the coil terminal being provided with a wire-end tying portion extending in a direction intersecting with the center axis of the coil and projecting outside of the bobbin; and the base may include a recess receiving the wire-end tying portion of the coil terminal.

Also, the base may include an abutment face abutted against the bobbin and locating the electromagnet at the fitting position.

The electromagnetic relay may further comprise an armature arranged between the electromagnet and the contact section, the armature being driven by the electromagnet and operating the contact section to open or close; and the contact section may include a stationary contact member having a stationary contact and fixedly supported on the base and a movable contact-spring member having a movable contact and supported on the yoke, the movable contact-spring member being attached to the armature and elastically displacing the movable contact while accompanying a movement of the armature.

BRIEF DESCRIPTION OF THE DRAWINGS

The above and other objects, features and advantages of the present invention will become more apparent from the following description of preferred embodiments in connection with the accompanying drawings, wherein.

DESCRIPTION OF THE PREFERRED EMBODIMENT

Figure 1:
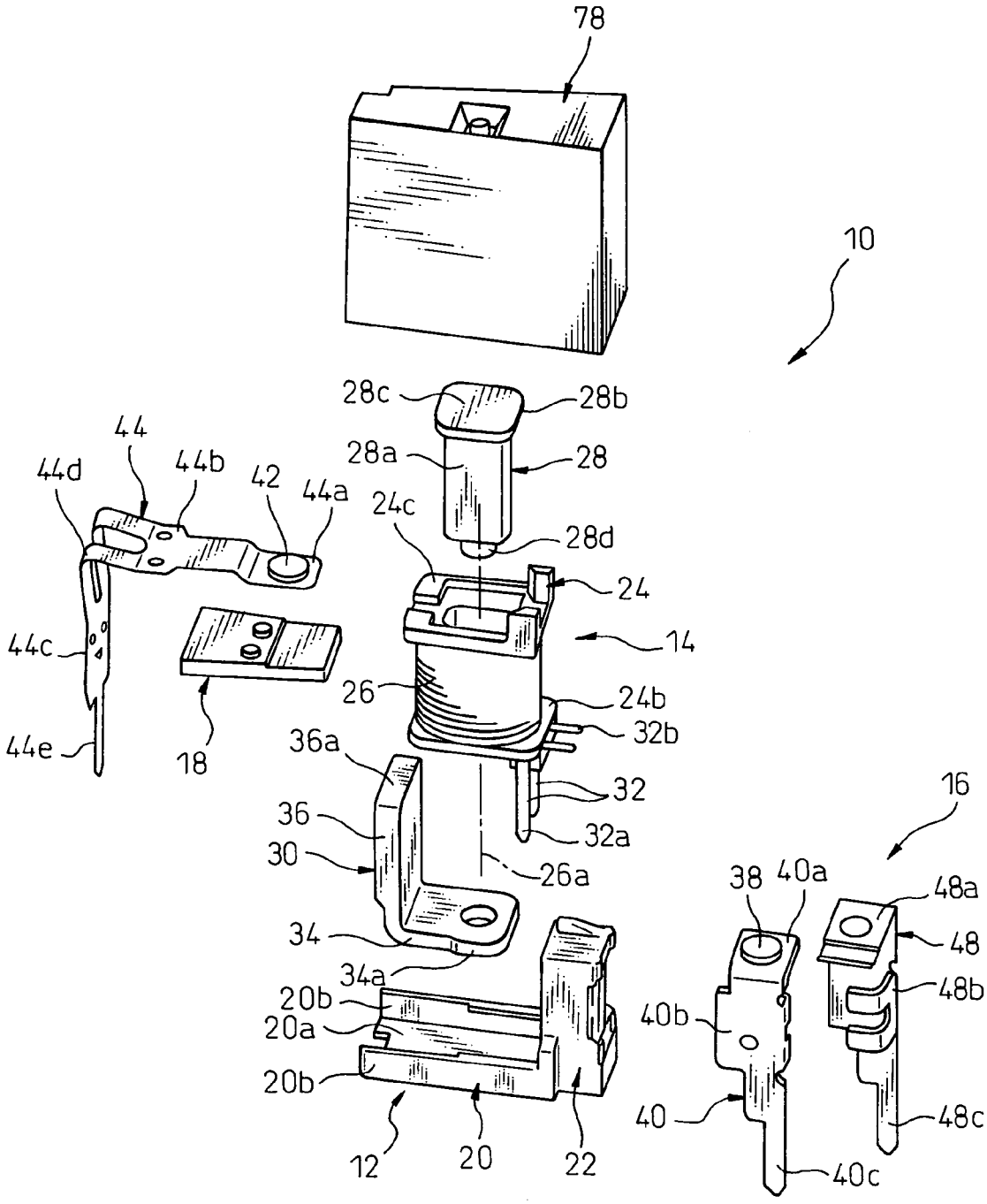
FIG. 1 is an exploded perspective view of an electromagnetic relay according to an embodiment of the present invention.

The embodiments of the present invention are described in detail below with reference to the accompanying drawings. In the drawings, the same or similar components are denoted by common reference numerals.

Figure 2:
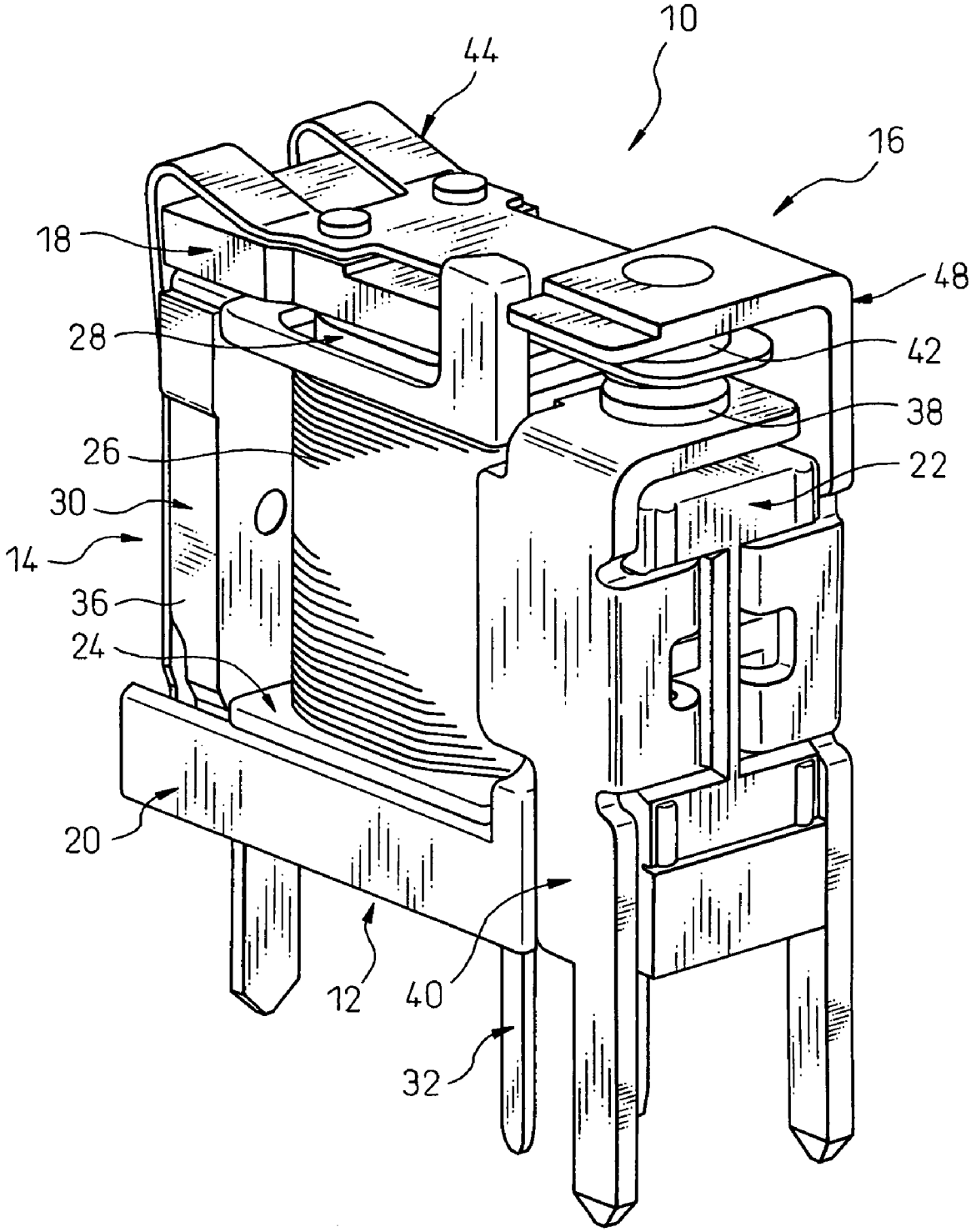
FIG. 2 is a perspective view showing the electromagnetic relay of FIG. 1 in an assembled state but a state where a casing is removed.
Figure 3:
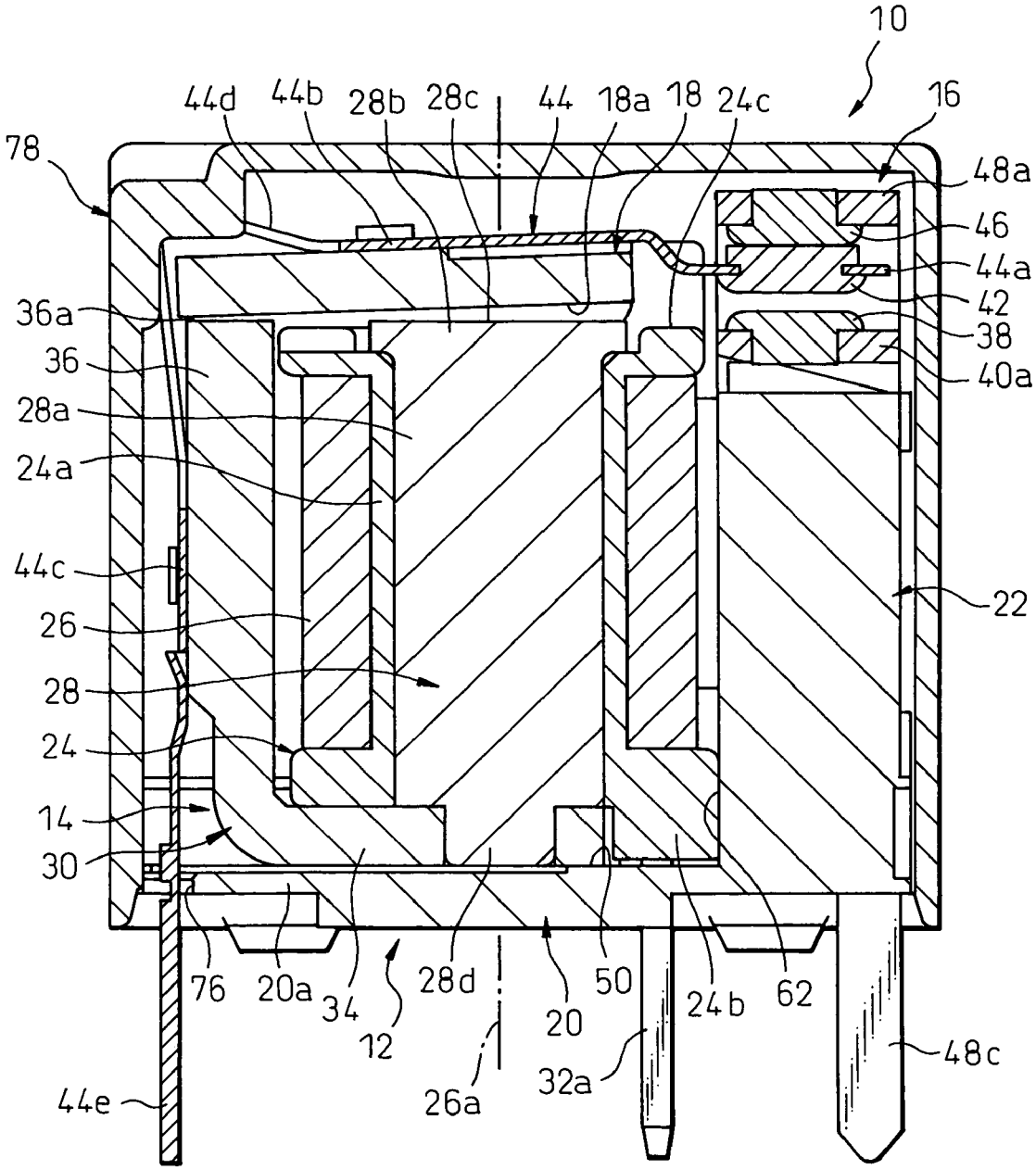
FIG. 3 is a vertical sectional view of the electromagnetic relay of FIG. 1 in the assembled state.
Figure 4:
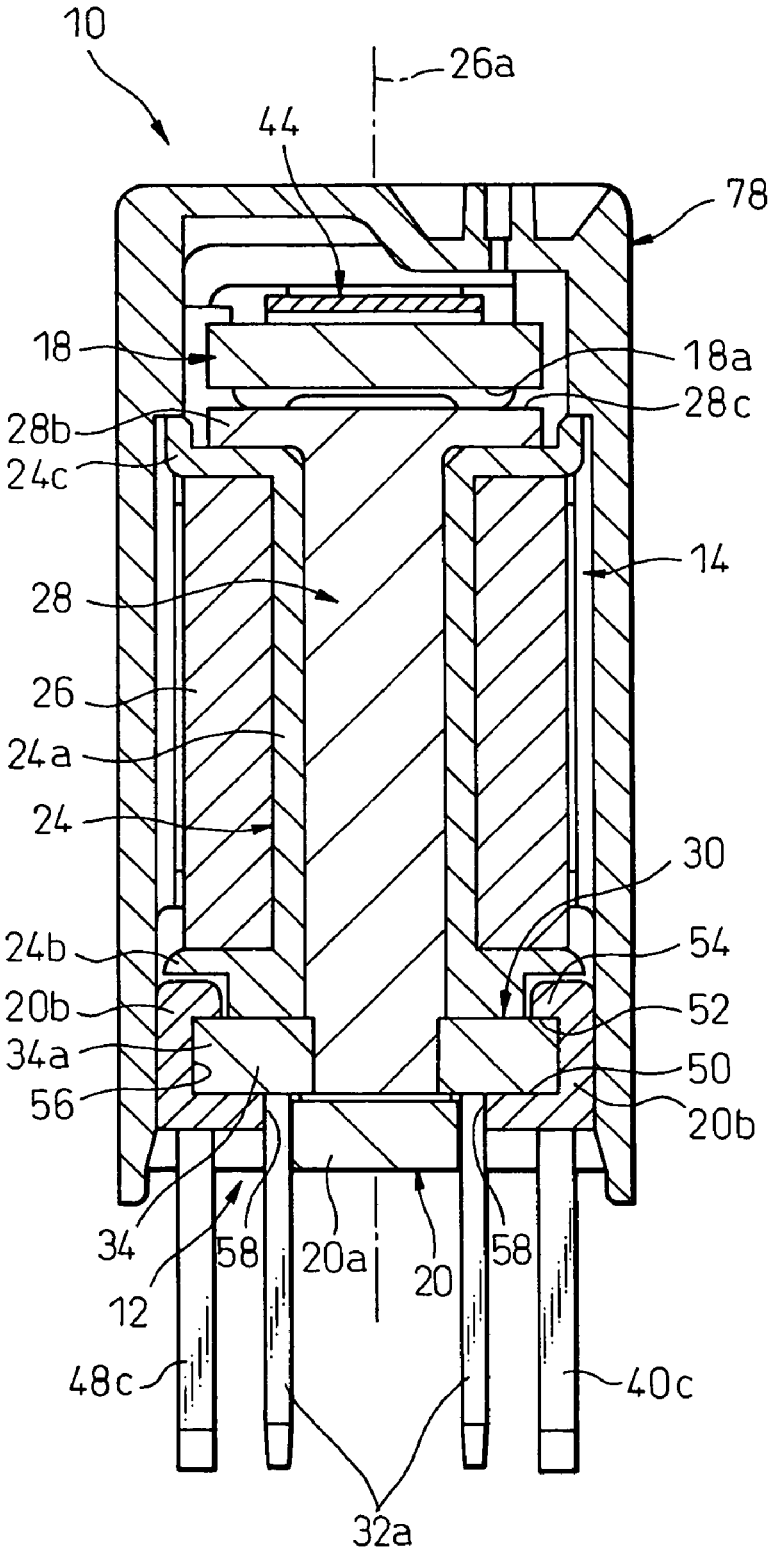
FIG. 4 is a sectional view of the electromagnetic relay taken along a line different from that in FIG. 3.

Referring to the drawings, FIG. 1 is an exploded perspective view showing an electromagnetic relay 10 according to an embodiment of the present invention, FIG. 2 is a perspective view of a main portion of the electromagnetic relay 10 in an assembled state, and FIGS. 3 and 4 are vertical sectional views of the electromagnetic relay 10.

The electromagnetic relay 10 includes a base 12, an electromagnet 14 fitted to or mounted on the base 12, and a contact section 16 fitted to or mounted on the base 12 and operable to open or close due to an operation of the electromagnet 14. An armature 18 is provided between the electromagnet 14 and the contact section 16, and is driven by the electromagnet 14 to operate the contact section 16 to open or close.

The base 12 is formed of an electrically-insulating resinous molded article, and is provided integrally with a first portion 20, on which the electromagnet 14 is mainly disposed, and a second portion 22, on which the contact section 16 is mainly disposed. The first portion 20, having a cradle-shape structure, includes a generally rectangular bottom plate 20*a* as seen in a plan view, and a pair of side plates 20*b* uprightly extending along opposite longitudinal edges of the bottom plate 20*a*. The second portion 22, having a column-shaped structure, is disposed at one shorter side of the bottom plate 20*a* of the first portion 20, and vertically extends sufficiently higher than the side plates 20*b* of the first portion 20. Another shorter side of the bottom plate 20*a* of the first portion 20 has an open configuration, as illustrated. The base 12, as a whole, has an L-shaped configuration as seen in a front view.

The electromagnet 14 includes a bobbin 24, a coil 26 having a center axis 26*a* and wound and supported on the bobbin 24, an iron core 28 incorporated into the bobbin 24 and disposed along the central axis 26*a* of the coil 26, and a yoke 30 extending from the iron core 28 to the outside of the bobbin 24 and the coil 26. The bobbin 24 is an electrically-insulating resinous molded article, and is provided integrally with a hollow body 24*a* having a predetermined length (FIG. 3), and first and second annular flanges 24*b*, 24*c* provided at longitudinally opposite ends of the body 24*a*. The coil 26 is formed by tightly winding a required length of an electrically conductive wire on the body 24*a* of the bobbin 24, and is securely held between the flanges 24*b*, 24*c* of the bobbin 24.

On the first flange 24*b* of the bobbin 24, a pair of coil terminals 32, made of a good electrical conductor, is fixedly provided or carried, through, e.g., an insert molding process. Each of the coil terminals 32 is integrally provided with a lead portion 32*a* extending in a direction generally parallel to the coil center axis 26*a* and projecting outside of the bobbin 24, and a wire-end tying portion 32*b* extending in a direction generally orthogonal to the coil center axis 26 and projecting outside of the bobbin 24, the coil terminals 32 being disposed substantially parallel to each other. When the electromagnet 14 is properly mounted on the first portion 20 of the base 12, the lead portions 32*a* of the respective coil terminals 32 project outward from the base 12. The respective wire ends (not shown) of the conductive wire forming the coil 26 are conductively tied to the wire-end tying portion 32*b* of the respective coil terminals 32.

The iron core 28 is a column-shaped member made of, e.g., magnetic steel, and includes a generally cylindrical main part 28*a* disposed coaxially with the center axis 26*a* of the coil 26 and fixedly received in the body 24*a* of the bobbin 24. At one axial end of the iron core 28, a head 28*b* is formed integrally with the main part 28*a* and extends from the latter in the direction generally orthogonal to the coil center axis 26*a*. The head 28*b* is arranged to be exposed outside of the second flange 24*c* of the bobbin 24 and has a flat end face 28*c* extending generally orthogonal to the coil center axis 26*a*. At the other axial end of the iron core 28, a small-diameter protrusion 28*d* is formed integrally with the main part 28*a*. The protrusion 28*d* projects slightly outside from the first flange 24*b* of the bobbin 24.

The yoke 30 is an L-shaped plate-like member made of, e.g., magnetic steel, and is fixedly joined to the protrusion 28*d* of the iron core 28 by, e.g., caulking, so as to form a magnetic path around the coil 26. The yoke 30 is provided integrally with a first plate portion 34 having a shorter length, joined to the protrusion 28*d* of the iron core 28 and disposed along the first flange 24*b* of the bobbin 24, and a second plate portion 36 having a longer length, disposed generally orthogonally to the first plate portion 34 and extending to be laterally spaced from the coil 26 and generally parallel to the coil center axis 26*a*. The first plate portion 34 of the yoke 30 is provided on a pair of lateral peripheral edges with projecting portions 34*a* slightly projecting outward therefrom. The distal end 36*a* of the second plate portion 36 of the yoke 30 is disposed in the neighborhood of the second flange 24*c* of the bobbin 24 at an axial position generally identical to that of the head end face 28*c* of the iron core 28. The armature 18 is rockably supported on the yoke 30 at a point adjacent to the distal end 36*a* (FIG. 3).

The armature 18, formed of a flat plate-like rigid member made of, e.g., magnetic steel, is supported on the yoke 30 of the electromagnet 14 through a movable contact-spring member, provided in the contact section 16 as described later, in a manner permitting an elastic relative movement, and is disposed to face the head 28*b* of the iron core 28. The armature 18 cooperates with the iron core 28 and the yoke 30 of the electromagnet 14, so as to form a magnetic circuit depending on the coil 26. As described later, when the electromagnet 14 is not energized, a major surface 18*a* of the armature 18 is held in a stationary state at a recovery or initial position spaced from the head end face 28*c* of the iron core 28 by a predetermined distance (FIG. 3). When the electromagnet 14 is energized, the armature 18 moves, in a rocking manner, due to a magnetic attractive force, in a direction for shifting the major surface 18*a* toward the head end face 28*c*.

The contact section 16 includes a first stationary contact member 40 having a make stationary contact 38, a movable contact-spring member 44 having a movable contact 42, and a second stationary contact member 48 having a break stationary contact 46. The first stationary contact member 40 is formed by punching an electrically conductive sheet metal into a predetermined shape and bending the punched sheet into an L-shape, and is provided with a carrying portion 40*a* at one longitudinal end for carrying the make stationary contact 38, an intermediate attachment portion 40*b* extending generally orthogonal to the carrying portion 40*a*, and a stationary-contact lead portion 40*c* at another longitudinal end and extending from the attachment portion 40*b* in a pin-like manner. The make stationary contact 38 is made of a desired contact material, and is fixed to the carrying portion 40*a* by, e.g., caulking, to bulge on a side away from the attachment portion 40*b*.

The second stationary contact member 48 is formed by punching an electrically conductive sheet metal into a predetermined shape and bending the punched sheet into an L-shape, and is provided with a carrying portion 48*a* at one longitudinal end for carrying the break stationary contact 46, an intermediate attachment portion 48*b* extending generally orthogonal to the carrying portion 48*a*, and a stationary-contact lead portion 48*c* at another longitudinal end and extending from the attachment portion 48*b* in a pin-like manner. The break stationary contact 46 is made of a desired contact material, and is fixed to the carrying portion 48*a* by, e.g., caulking, to bulge on a side close to the attachment portion 48*b*.

Each of the first and second stationary contact members 40, 48 is fixedly attached to the second portion 22 of the base 12 as described later. In this connection, the second stationary contact member 48 is longer than the first stationary contact member 40, mainly due to the fact that the attachment portion 48*b* of the former is longer than the attachment portion 40*b* of the latter. Therefore, in a state where the first and second stationary contact members 40, 48 are properly attached to the second portion 22 of the base 12, the make stationary contact 38 and the break stationary contact 46 are spaced from each other in the direction of the coil center axis 26*a* of the electromagnet 14 (in a vertical direction, in the drawing), and are disposed at mutually facing positions with the distance therebetween fixedly maintained (FIG. 3).

The movable contact-spring member 44 is an electrically-conductive thin plate member, and is formed by, e.g., punching a spring sheet of phosphor bronze into a predetermined shape and bending the punched sheet into an L-shape, and is provided integrally with a carrying portion 44*a* at one longitudinal end for carrying the movable contact 42, a first attachment portion 44*b* extending from and generally parallel to the carrying portion 44*a*, a second attachment portion 44*c* extending in a direction generally orthogonal to the first attachment portion 44*b*, an elastic hinge portion 44*d* extending at generally center of the member 44 in an L-shape between the a first attachment portion 44*b* and the second attachment portion 44*c*, and a movable-contact lead portion 44*e* extending at another longitudinal end from the second attachment portion 44*c* in a pin-like manner at a side opposite to the elastic hinge portion 44*d*.

The movable contact-spring member 44 is supported on the electromagnet 14, with the first attachment portion 44*b* being fixed to the armature 18 by, e.g., caulking and the second attachment portion 44*c* being fixed to the second plate portion 36 of the yoke 30 by, e.g., caulking. In this state, the carrying portion 44*a* of the movable contact-spring member 44 extends outward beyond the second flange 24*c* of the bobbin 24 in a direction intersecting with the coil center axis 26*a*. On the other hand, the movable-contact lead portion 44*e* of the movable contact-spring member 44 extends outward beyond the first flange 24*b* of the bobbin 24 in a direction generally parallel to the coil center axis 26*a* (FIG. 3).

The movable contact 42 is made of a desired contact material, and is fixed to the carrying portion 44*a* by, e.g., caulking, to bulge on both sides of the carrying portion 44*a*. In a state where the movable contact-spring member 44 is properly attached to the electromagnet 14 and the electromagnet 14 is properly fitted to the first portion 20 of the base 12, the movable contact 42 is disposed between the make stationary contact 38 and the break stationary contact 46 in a manner displaceable in a direction generally parallel to the coil center axis 26*a* of the electromagnet 14 (in a vertical direction, in the drawing), so that the movable contact 42 can alternately come into contact with the first and second stationary contacts 38, 46 (FIG. 3).

The movable contact-spring member 44 acts to bias or urge the armature 18 in a direction away from the head 28*b* of the iron core 28, under the spring function of the elastic hinge portion 44*d* exerted between the armature 18 and the yoke 30. Therefore, when the electromagnet 14 is not energized, the armature 18 is held in a stationary state at a recovery or initial position where the major surface 18*a* is spaced from the head end face 28*c* of the iron core 28 by a predetermined distance (FIG. 3), under the spring function of the movable contact-spring member 44, with one end (the left end, in FIG. 3) of the armature 18 being adjacent to the distal end 36*a* of the second plate portion 36 of the yoke 30. In this state, the movable contact 42 of the movable contact-spring member 44 comes into contact with the break stationary contact 46 of the second stationary contact member 48 under pressure, so as to close a break contact. When the electromagnet 14 is energized, from the recovery position, the armature 18 moves in a rocking manner due to a magnetic attractive force, about one end of the armature adjacent to the yoke distal end 36*a*, in a direction shifting toward the iron core head section 28*b*, against the spring force of the elastic hinge portion 44*d* of the movable contact-spring member 44. With this rocking movement, the movable contact 42 of the movable contact-spring member 44 comes into contact with the make stationary contact 38 of the first stationary contact member 40 under pressure, so as to close a make contact.

In the electromagnetic relay 10, several measures are taken for enabling above-described various components to be easily assembled together, with a high positional accuracy, while meeting a requirement for miniaturization and inhibiting increase in manufacturing cost. Hereinafter, the measures will be described.

Figure 5:
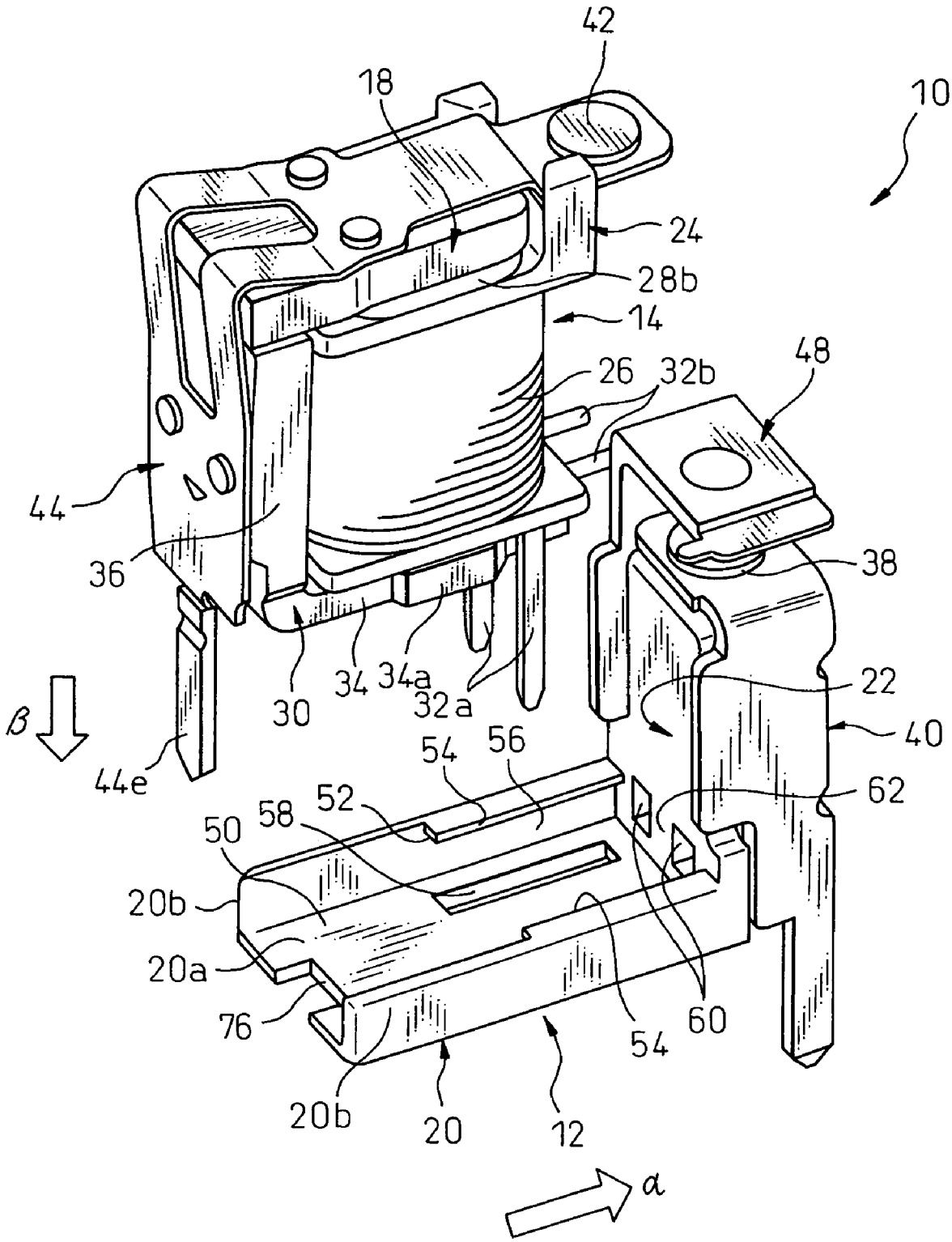
FIG. 5 is an exploded perspective view showing an electromagnet block and a base block, which are to be fitted to each other, just before being fitted to each other.

As shown in FIGS. 4 and 5, the base 12 includes a retaining face 50 firstly coming into contact with the yoke 30, in a step or action of fitting the electromagnet 14 to the base 12, and retaining the electromagnet 14 at a predetermined height on the base 12 as seen in a direction of the coil center axis 26*a*, and a guide face 52 slidably engaged with the yoke 30, by shifting the yoke 30 along the retaining face 50, and guiding the electromagnet 14 in a fitting direction intersecting with the coil center axis 26*a* (shown by an arrow a in FIG. 5). In a state where the electromagnet 14 is properly fitted to or mounted on the first portion 20 of the base 12, the retaining face 50 and the guide face 52 cooperate with each other to fixedly support the electromagnet 14 at a predetermined fitting position on the base 12 (shown in FIGS. 2 and 3).

The retaining face 50 is formed on the bottom plate 20*a* of the first portion 20 of the base 12, and the guide face 52 is formed on each of the side plates 20*b* of the first portion 20. More specifically, the side plates 20*b* of the base first portion 20 are provided, along respective top edges thereof apart from the bottom plate 20*a*, with flanged portions 54 projecting in a direction toward each other and extending continuously and straightly in the fitting direction α. The guide face 52 is formed on each flanged portion 54 at a side thereof opposite to the bottom plate 20*a* of the base first portion 20. On the other hand, the retaining face 50 is formed on the surface (the upper surface, in the drawing) of the bottom plate 20*a*, which is spaced from each flanged portion 54 and extends parallel to the guide face 52.

The base 12 is further provided with grooves 56 extending straightly in the fitting direction α, each groove 56 being defined between the retaining face 50 formed on the bottom plate 20*a* of the first portion 20 and the guide face 52 formed on the flanged portion 54 of each side plate 20*b*. A pair of projecting portions 34*a* oppositely formed on the outer periphery of the first plate portion 34 of the yoke 30 are slidably received in the respective grooves 56, preferably in a press-fit condition. As described later, in a step or action of fitting the electromagnet 14 to the first portion 20 of the base 12, the projecting portions 34*a* oppositely formed on the outer periphery of the first plate portion 34 of the yoke 30 are inserted into the respective grooves 56 formed in association with the opposite side plates 20*b* of the first portion 20 and are slid in the fitting direction α, whereby the electromagnet 14 is automatically guided into a proper fitting position on the base 12.

The first portion 20 of the base 12 is provided with a pair of through holes 58, formed at predetermined positions of the bottom plate 20*a*, for respectively receiving the lead portions 32*a* of the pair of coil terminals 32 of the electromagnet 14. Each through hole 58 has a shape (a slit shape extending linearly in the direction α, in the drawing) as to receive the corresponding lead portion 32*a* by shifting the electromagnet 14 relatively to the base 12 in a direction intersecting with the fitting direction α (shown by an arrow β in FIG. 5) and to permit the electromagnet 14 to be shifted in the fitting direction α with the lead portions 32*a* being received in the through holes, during the step or action of fitting the electromagnet 14 to the base 12.

The second portion 22 of the base 12 is provided with a pair of recesses 60, formed at predetermined positions in the vicinity of the bottom plate 20*a*, for respectively receiving the wire-end tying portions 32*b* of the pair of coil terminals 32 of the electromagnet 14. The second portion 22 of the base 12 is further provided with an abutment face 62, formed around the pair of recesses 60, to be abutted against the first flange 24*b* of the bobbin 24 of the electromagnet 14 and to locate the electromagnet 14 at the predetermined fitting position.

Figure 6:
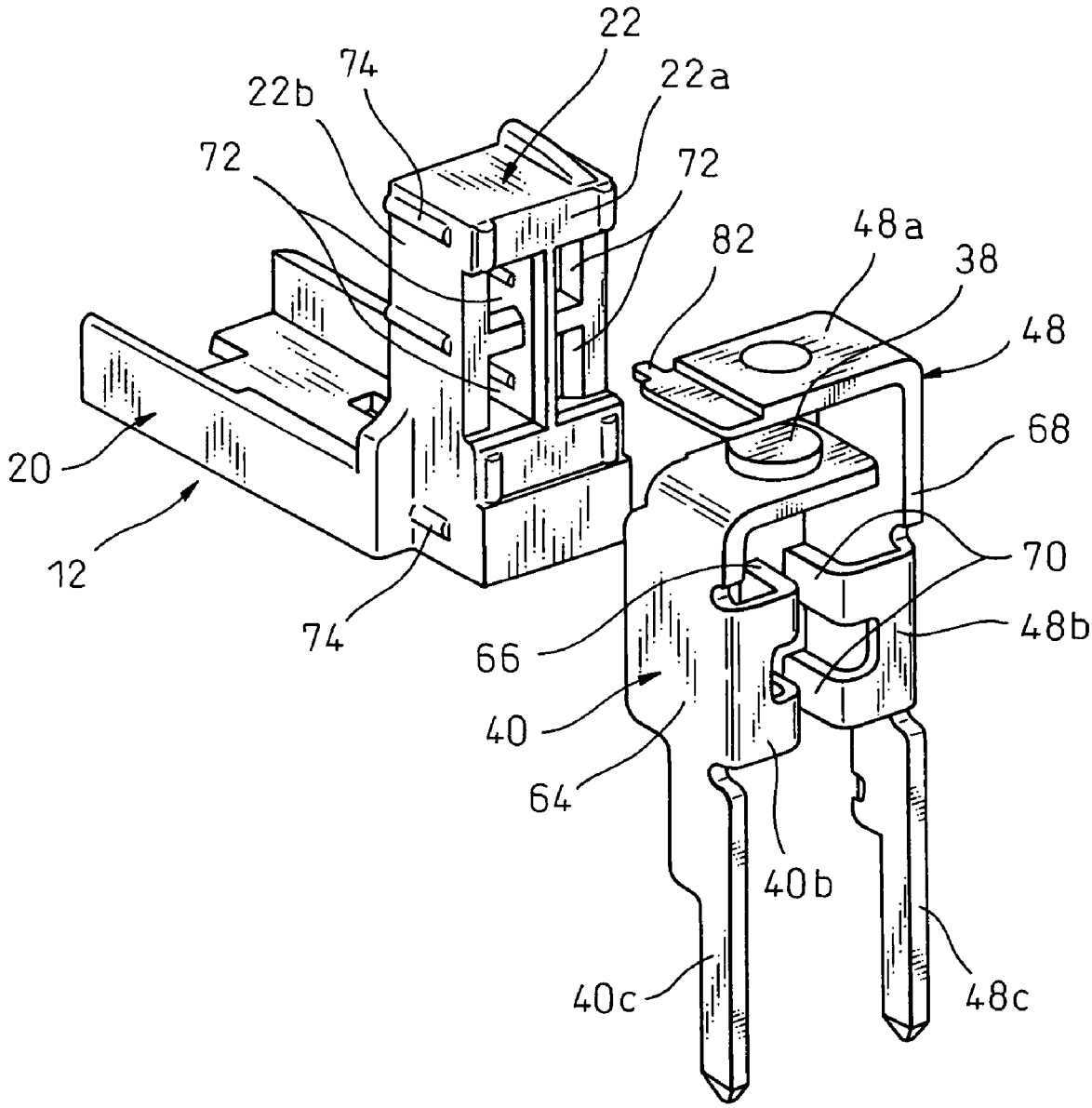
FIG. 6 is an exploded perspective view showing a state just before a stationary contact member is attached to a base.

As shown in FIG. 6, the first stationary contact member 40 is formed in such a manner that the attachment portion 40*b* thereof includes a main part 64 defined adjacent to the stationary-contact lead portion 40*c* and a catch 66 (two catches 66, in the drawing) defined at a distal end and oppositely spaced from the main part 64. Similarly, the second stationary contact member 48 is formed in such a manner that the attachment portion 48*b* thereof includes a main part 68 defined adjacent to the stationary-contact lead portion 48*c* and a catch 70 (two catches 70, in the drawing) defined at a distal end and oppositely spaced from the main part 68.

Correspondingly, the second portion 22 of the base 12 is provided with a plurality of (four, in the drawing) silts 72, recessed in the face 22*a* opposite to the abutment face 62 (FIG. 5), for respectively receiving the catches 66, 70 of the first and second stationary contact members 40, 48 in a press-fit manner. The second portion 22 of the base 12 is further provided on lateral outer faces 22*b* of the second portion 22 (i.e., the outer faces of outer walls defining the slits 72) with a plurality of (three for each outer faces 22*b*, in the drawing) ribs 74 projecting locally to be abutted respectively against the main parts 64, 68 of the first and second stationary contact members 40, 48 under pressure (only the ribs 74 on one outer face 22*b* are shown). The abutment pressure between the main parts 64, 68 of the stationary contact members 40, 48 and the respective ribs 74 can be obtained by an elastic deformation of the corresponding catches 66, 70.

Figure 7:
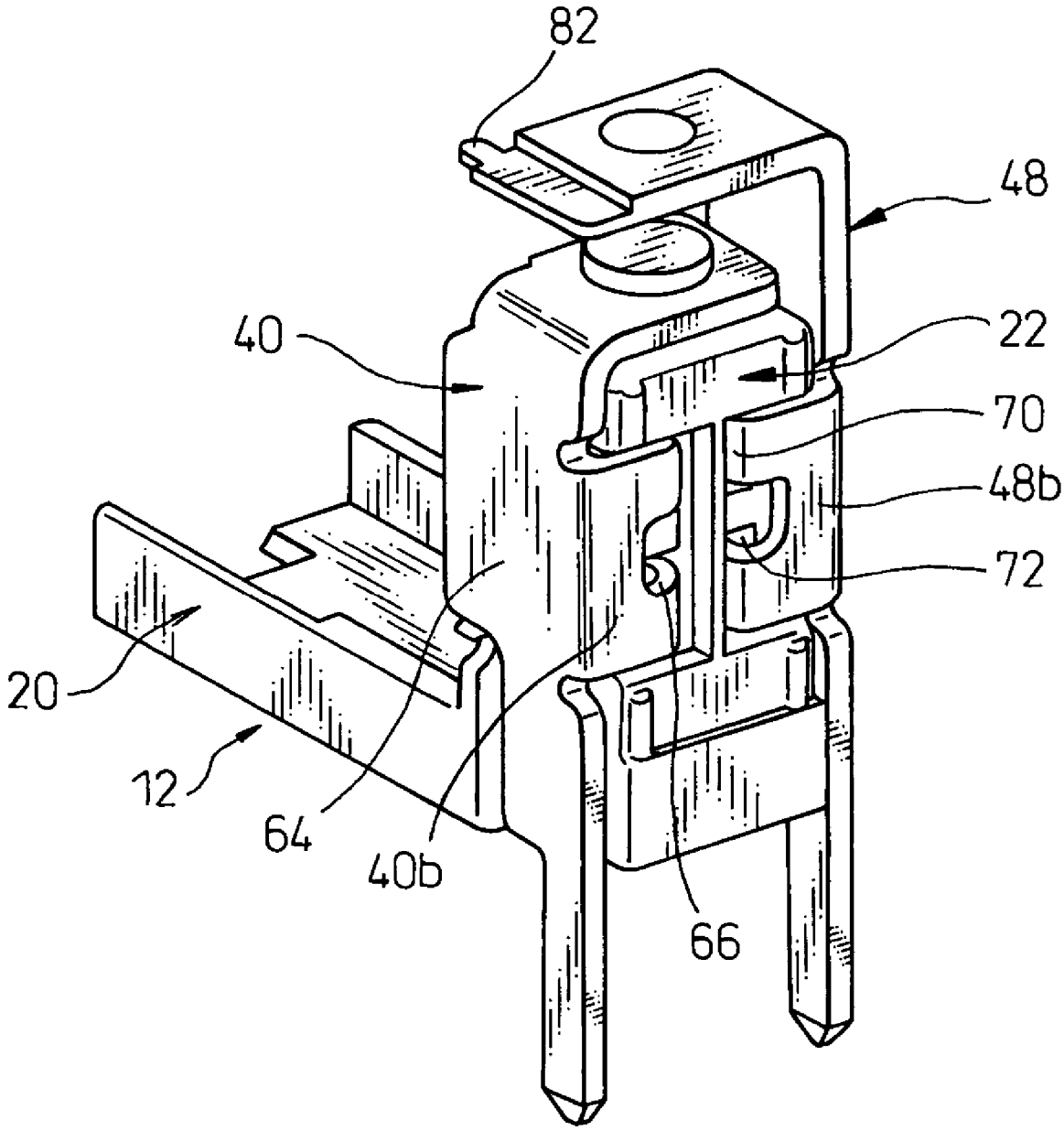
FIG. 7 is a perspective view showing a state where the stationary contact member is attached to the base.

The first and second stationary contact members 40, 48 are properly fixed to the second portion 22 of the base 12 by press-fitting the respective catches 66, 70 into the corresponding slits 72 formed in the base second portion 22 (FIG. 7). In this connection, the main parts 64, 68 of the first and second stationary contact members 40, 48 are abutted on the ribs 74 formed on the lateral outer faces 22*b* of the base second portion 22 under elastic pressure, so that the attachment portions 40*b*, 48*b* of the stationary contact members 40, 48 act to hold therebetween the outer wall of the base second portion 22 defining the slits 72. As a result, the first and second stationary contact members 40, 48 are firmly fixed at predetermined positions on the second portion 22 of the base 12.

The positions of the catches 66, 70 on the attachment portions 40*b*, 48*b* of the respective stationary contact members 40, 48, and the positions of the slits 72 in the second portion 22 of the base 12 may be set appropriately with reference to the retaining face 50 formed on the first portion 20 of the base 12. In other words, it is effectual that the catches 66, 70 and the slits 72 are formed in such a manner that, at an instant when the stationary contact members 40, 48 are properly attached to the second portion 22 of the base 12, the contacting end faces of the stationary contacts 38, 46 are disposed at positions apart from the retaining face 50 of the base 12 by predetermined distances. Due to this arrangement, it is possible to dispose the stationary contacts 38, 46 at predetermined positions on the base 12 with high positional accuracy, merely by attaching the stationary contact members 40, 48 to the base second portion 22 in a press-fit manner (FIG. 3). In this respect, the press-fit attachments of the first and second stationary contact members 40, 48 are performed in an identical direction relative to the base 12, so that an attaching work becomes easier and can be readily automated. Further, the stationary contact members 40, 48 may be attached to the base 12 through an insert molding process, which can further ease the attaching work.

Figure 8:
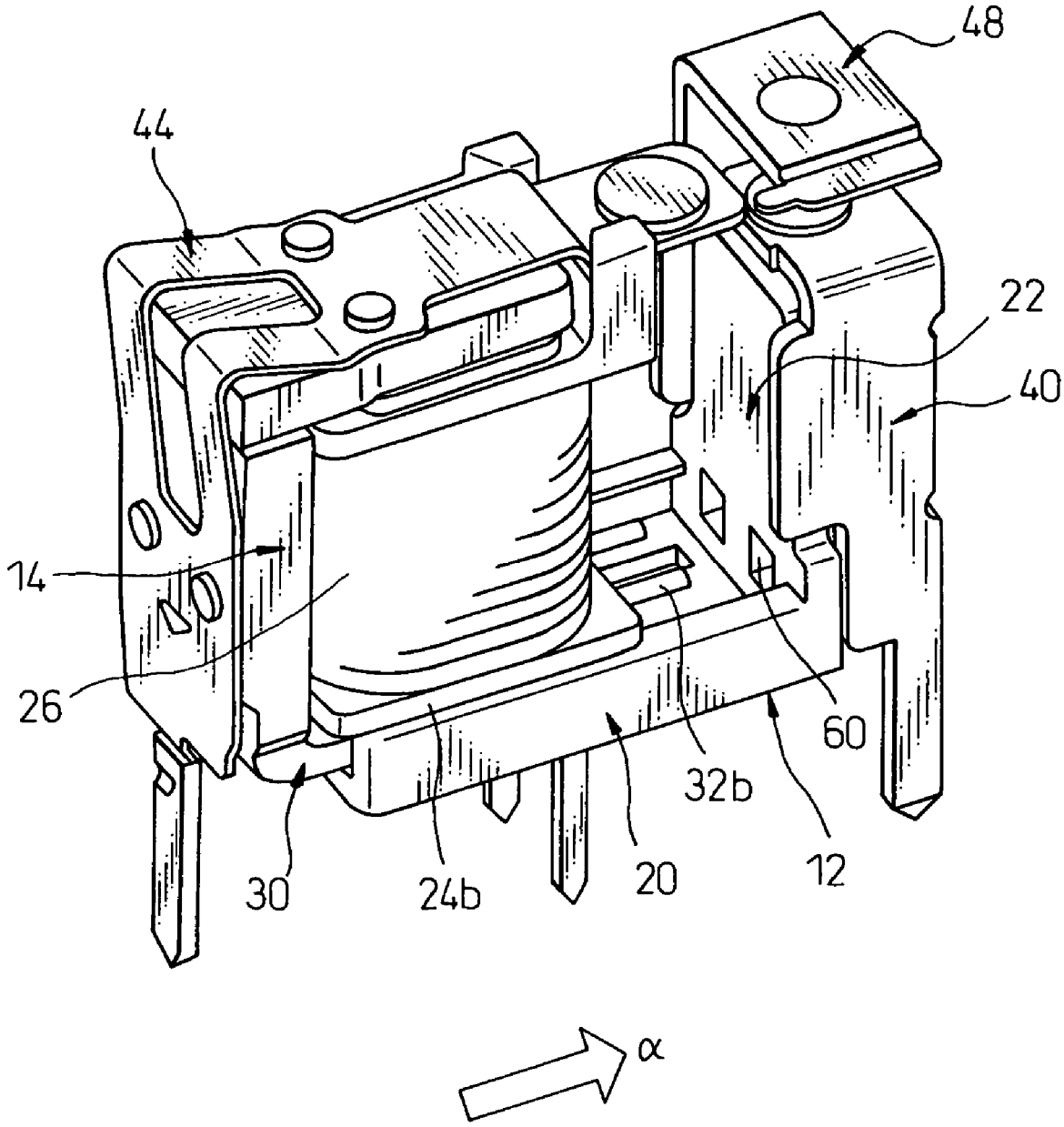
FIG. 8 is a perspective view showing the electromagnet block and the base block, shown in FIG. 5, at a halfway position in a fitting step.
Figure 9:
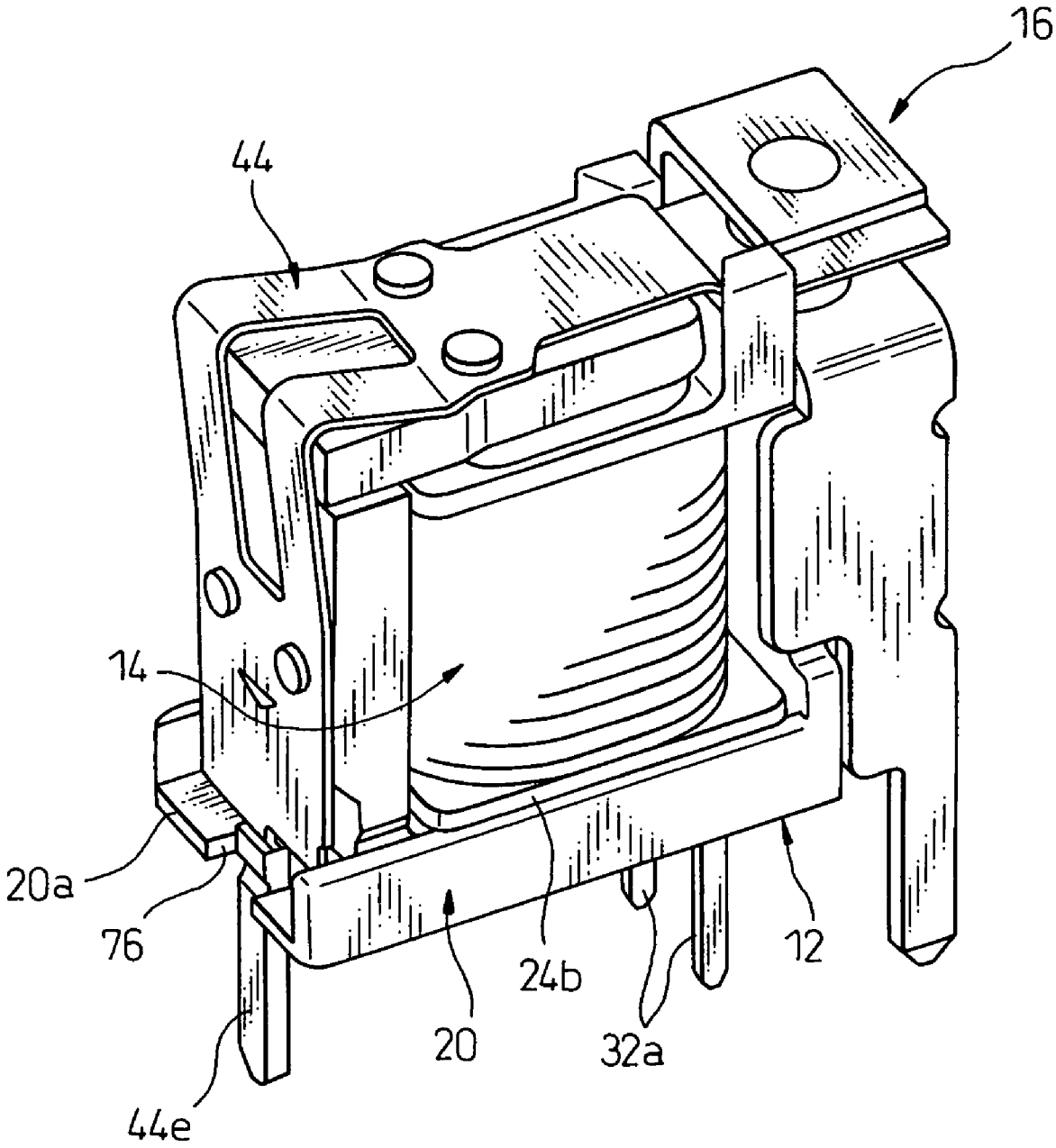
FIG. 9 is a perspective view showing the electromagnet block and the base block, shown in FIG. 5, at a finish position in the fitting step.

Referring now to FIGS. 5, 8 and 9, a procedure for fitting the electromagnet 14 to the first portion 20 of the base 12 will be described below.

First, an electromagnet block is prepared by attaching the armature 18 and the movable contact-spring member 44 to the electromagnet 14 including the bobbin 24, the coil 26, the iron core 28, the yoke 30 and the coil terminals 32, as described above. In this electromagnet block, the movable contact-spring member 44 is secured to the armature 18 and the yoke 30 by securing means having high mechanical strength, such as caulking, so that it is possible to ensure the position and travel of the armature 18 (i.e., of the movable contact 42) relative to the iron core head 28*b* with high accuracy. On the other hand, a base block is prepared by attaching the first and second stationary contact members 40, 48 to the base 12 with high accuracy, as described above.

An assembling worker disposes the first plate portion 34 of the yoke 30 of the electromagnet 14 to be opposed to the bottom plate 20*a* of the first portion 20 of the base 12 and, from this position, shifts the electromagnet block relatively to the base block in the above-described direction β defined by the correlation between the pair of through holes 58 formed in the base first portion 20 and the lead portions 32*a* of the pair of coil terminals 32 of the electromagnet 14 (FIG. 5). In this shifting step, it is effective that the electromagnetic block is shifted in such a manner that the wire-end tying portions 32*b* of the coil terminals 32 of the electromagnet 14 do not collide with the second portion 22 of the base 12 and the projecting portions 34*a* of the first plate portion 34 of the yoke 30 do not collide with the flanged portions 54 of the first portion 20 of the base 12, whereby it is possible to smoothly insert the lead portions 32*a* into the corresponding through holes 58. Therefore, the direction β is specified on the basis of the positional relationship between the lead portion 32*a* and the wire-end tying portion 32*b*, the positional relationship between the lead portion 32*a* and the projecting portion 34*a*, the positional relationship between the flanged portion 54 and the through hole 58, and the like. In the illustrated embodiment, the direction β is defined as to be generally orthogonal to the bottom plate 20*a* of the base first portion 20 (a downward direction, in the drawing).

As described above, when the electromagnet block is shifted in the direction β relatively to the base block, the lead portions 32*a* of the coil terminals 32 of the electromagnet 14 are inserted into the corresponding through holes 58 of the base first portion 20 and, generally simultaneously therewith, the yoke 30 of the electromagnet block firstly comes into contact with the retaining face 50 provided on the bottom plate 20*a* of the base first portion 20, so as to retain the electromagnet 14 at a predetermined height on the base 12 as seen in the direction of the coil center axis 26*a* (FIG. 8). From this state, when the electromagnet 14 is shifted on the base 12 in the fitting direction α, the yoke 30 is moved to slide on the retaining face 50, and the projecting portions 34*a* of the yoke 30 are slidingly engaged with the corresponding guide faces 52 provided on the flanged portions 54 of the base 12 and thus are fitted into the grooves 56, while the electromagnet 14 is maintained at the predetermined height.

As the electromagnet block is shifted relatively to the base block in the fitting direction α, the lead portions 32*a* of the coil terminals 32 of the electromagnet 14 are moved along the corresponding through holes 58 of the base first portion 20, and the wire-end tying portions 32*b* of the coil terminals 32 are received, from the distal ends thereof, in the corresponding recesses 60 of the base second portion 22. At the same time, the movable contact 42 of the movable contact-spring member 44 is inserted between the stationary contacts 38, 46 of the first and second stationary contact members 40, 48. In the meantime, the yoke 30 is slidingly engaged with the retaining face 50 and the guide faces 52 of the base 12 and, thereby, the electromagnet block is shifted accurately in the fitting direction α, so that the wire-end tying portions 32*b* of the coil terminals 32 are accurately received in the recesses 60 of the base second portion 22 without obstruction, and that the movable contact 42 is accurately inserted between the stationary contacts 38, 46 without obstruction.

Finally, the first flange 24*b* of the bobbin 24 of the electromagnet 14 is abutted, at a region around the proximal ends of the wire-end tying portions 32*b* of the coil terminals 32, against the abutment face 62 of the second portion 22 of the base 12. As a result, the electromagnet 14 is accurately located at a predetermined fitting position on the base 12 (FIG. 9). In the fitting position, the projecting portions 34*a* of the yoke 30 of the electromagnet 14 come into tightly contact, and are engaged preferably in a press-fit manner, with the retaining face 50 and the guide faces 52 of the base 12, so that the electromagnet 14 is fixedly retained on the base 12 (see FIG. 4).

In the above-described proper fitting position, the head end face 28*c* of the iron core 28 of the electromagnet 14, facing oppositely to the armature 18, is accurately located at a position predetermined in relation to the retaining face 50 of the base 12 as a reference plane. As a result, the movable contact 42 is accurately disposed at a predetermined position and is accurately displaced along a predetermined travel, relatively to the pair of stationary contacts 38, 46 that is also accurately located in relation to the retaining face 50 (or the reference plane) of the base 12.

As described above, in the electromagnetic relay 10, in the action of fitting or mounting the electromagnet 14 to the base 12, the yoke 30 of the electromagnet 14 firstly comes into contact with the retaining face 50 of the base 12, and thereby the electromagnet 14 is held at a predetermined height on the base 12. In this first step, it is possible for the worker to recognize the contacting state between the yoke 30 and the retaining face 50 by feel (or blindly), without relying on visual inspection. Then, the yoke 30 is moved to slide along the retaining face 50, and thereby the yoke 30 is slidingly engaged with the guide faces 52 of the base 12 and the electromagnet 14 is thus accurately guided in the fitting direction α under the function of the guide faces 52. In this second step, it is also possible for the worker to automatically guide the electromagnet 14 into the proper fitting position, merely by shifting the electromagnet 14 in such a manner that the yoke 30 slides along the retaining face 50, without relying on visual inspection. Therefore, in the electromagnetic relay 10, even when dimensions of components are reduced to meet a requirement of miniaturization, it is possible to easily and accurately fit or mount the electromagnet 14 to the base 12 at a proper fitting position thereon. Moreover, the electromagnetic relay 10 is configured such that the yoke 30 made of a metallic material is inserted between the retaining face 50 and the guide faces 52 of the base 12 made of a resinous material in a sliding (preferably, a press-fitting) manner, so that the molding dimensional accuracy required for the components is not so strict and, as a result, it is possible to prevent the manufacturing cost from increasing.

Although the above-described embodiment is configured such that the retaining face 50 and the guide faces 52 of the base 12 are slidingly engaged with the yoke 30 of the electromagnet 14, an alternative modification may be provided wherein projecting portions, similar to the yoke projecting portions 34*a* described above, are formed on the first flange 24*b* of the bobbin 24 of the electromagnet 14, and the retaining face 50 and the guide faces 52 are slidingly engaged with the projecting portions of the bobbin 24. As another alternative modification, the projecting portions 34*a* of the yoke 30 and the projecting portions of the bobbin 24 may be closely fitted, as a whole, into the grooves 56 between the retaining face 50 and the guide faces 52. In either modification, the effect comparable to that of the illustrated embodiment can be achieved.

In the illustrated electromagnetic relay 10, the configuration, in which the projecting portions 34*a* of the yoke 30 are closely fitted into the grooves 56 formed between the retaining face 50 and the guide faces 52, has a remarkable advantage from the viewpoint that the electromagnet 14 is guided in the fitting direction α more stably. Also, the configuration, in which the bobbin 24 of the electromagnet 14 is abutted against the abutment face 60 of the base 12 so as to locate the electromagnet 14 at the fitting position, ensures a significant improvement of the reliability of the fitting work without relying on a visual inspection. Further, the configuration, in which the base 12 is provided with the recesses 60 receiving the wire-end tying portions 32*b* of the coil terminals 32, makes it possible to effectively reduce the overall dimensions of the electromagnetic relay 10.

In the electromagnetic relay 10, it is advantageous that the first portion 20 of the base 12 is provided with a notch 76 (FIGS. 3, 5, 9) receiving the movable-contact lead portion 44*e* of the movable contact-spring member 44 without obstruction, at an instant when the electromagnetic 14 is disposed at a proper fitting position on the base 12, from the viewpoint of reducing the overall dimensions of the electromagnetic relay 10. The notch 76 is formed at the open shorter side of the bottom plate 20*a* of the base first portion 20, and has a shape (rectangular, in the illustrated embodiment) to allow the electromagnet 14 to be shifted in the fitting direction α. This configuration makes it possible to surely avoid an inconvenience, arising in the known configuration in which the movable-contact lead portion of the movable contact-spring member is inserted into the through hole formed in the base, such that the movable-contact lead portion 44*e* may cut or damage the material of the base 12.

Figure 10:
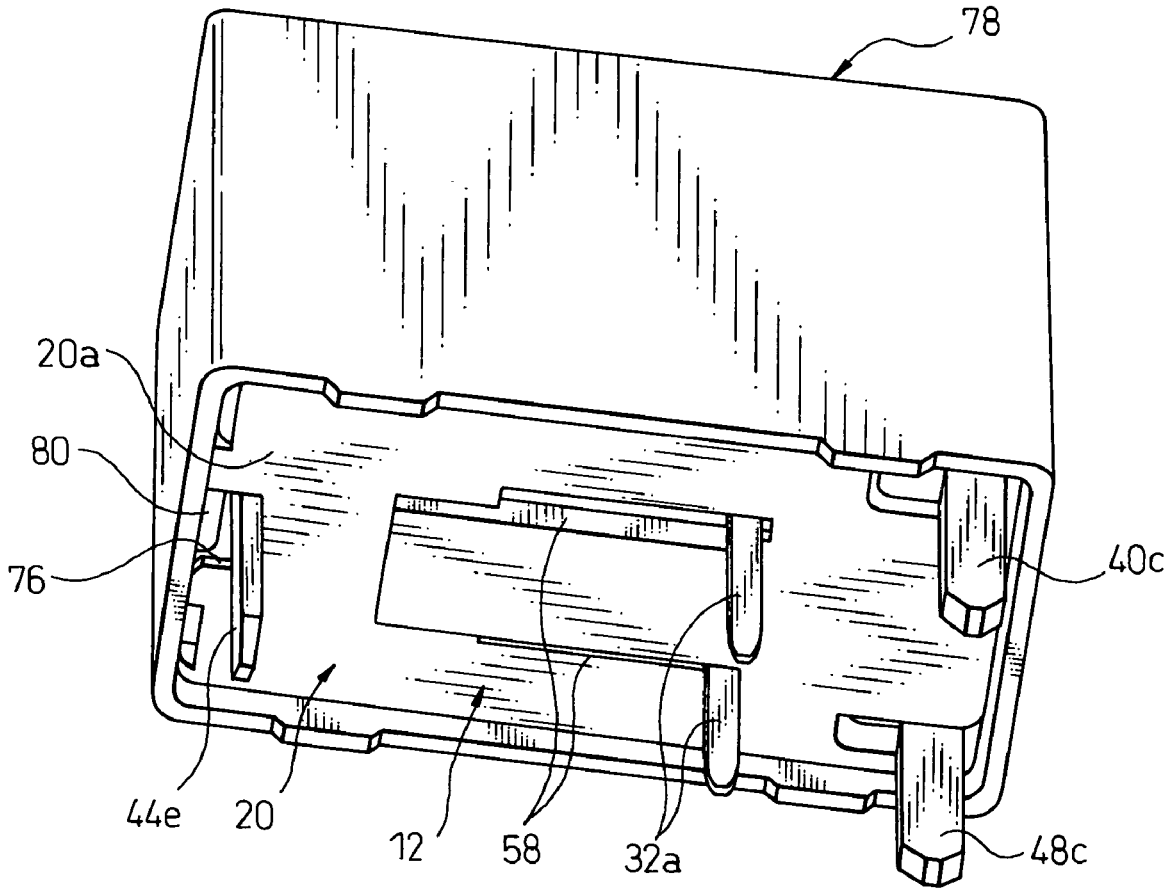
FIG. 10 is a perspective view of the electromagnetic relay of FIG. 1 in the assembled state, showing a bottom face of a first portion of the base.

The electromagnetic relay 10 is further provided with a casing 78 adapted to be securely fitted to the base 12 in a state where the casing 78 accommodates the electromagnet 14 and contact section 16 also fitted to the base 12 (FIG. 1). In the final step of the assembling process of the electromagnetic relay 10, the casing 78 contains the electromagnet 14 and the contact section 16 in its interior space and is adhered hermetically to the base 12 by a thermosetting adhesive. Further, the casing 78 may be provided with a projection 80 received in the notch 76 of the base 12 at a position adjacent to the movable-contact lead portion 44*e* of the movable contact-spring member 44 (FIG. 10). The projection 80 acts to fill a clearance formed in the notch 76 of the base 12 and to bear an external bending force applied to the movable-contact lead portion 44*e*.

Further, in the electromagnetic relay 10, the second stationary contact member 48 may further be provided with an auxiliary attachment portion 82 defined adjacent to the stationary contact 46 and projecting horizontally at a distal end position on the carrying portion 48*a* away from the attachment portion 48*b* (FIGS. 6, 7). The auxiliary attachment portion 82 is formed, as a thinner extension, by, e.g., crushing and punching the material of the distal end region of the carrying portion 48*a*. At an instant when the electromagnet 14 is fitted to the base 12 at the predetermined fitting position thereon, the auxiliary attachment portion 82 of the second stationary contact member 48 is securely received in a bore (not shown) formed at the corresponding position of the second flange 24*c* of the bobbin 24, so that the carrying portion 48*a* (therefore, the break stationary contact 46) of the second stationary contact member 48 is fixedly held at a predetermined position against an external force.

In this connection, the auxiliary attachment portion 82, as described above, may also be provided on the first stationary contact member 40. Further, although the electromagnetic relay 10 in the illustrated embodiment is provided with the second stationary contact member 48 having the break stationary contact 46, the second stationary contact member 48 may be replaced by a back support member (also referred to as a back stop) that does not have a contact function.

Figure 11:
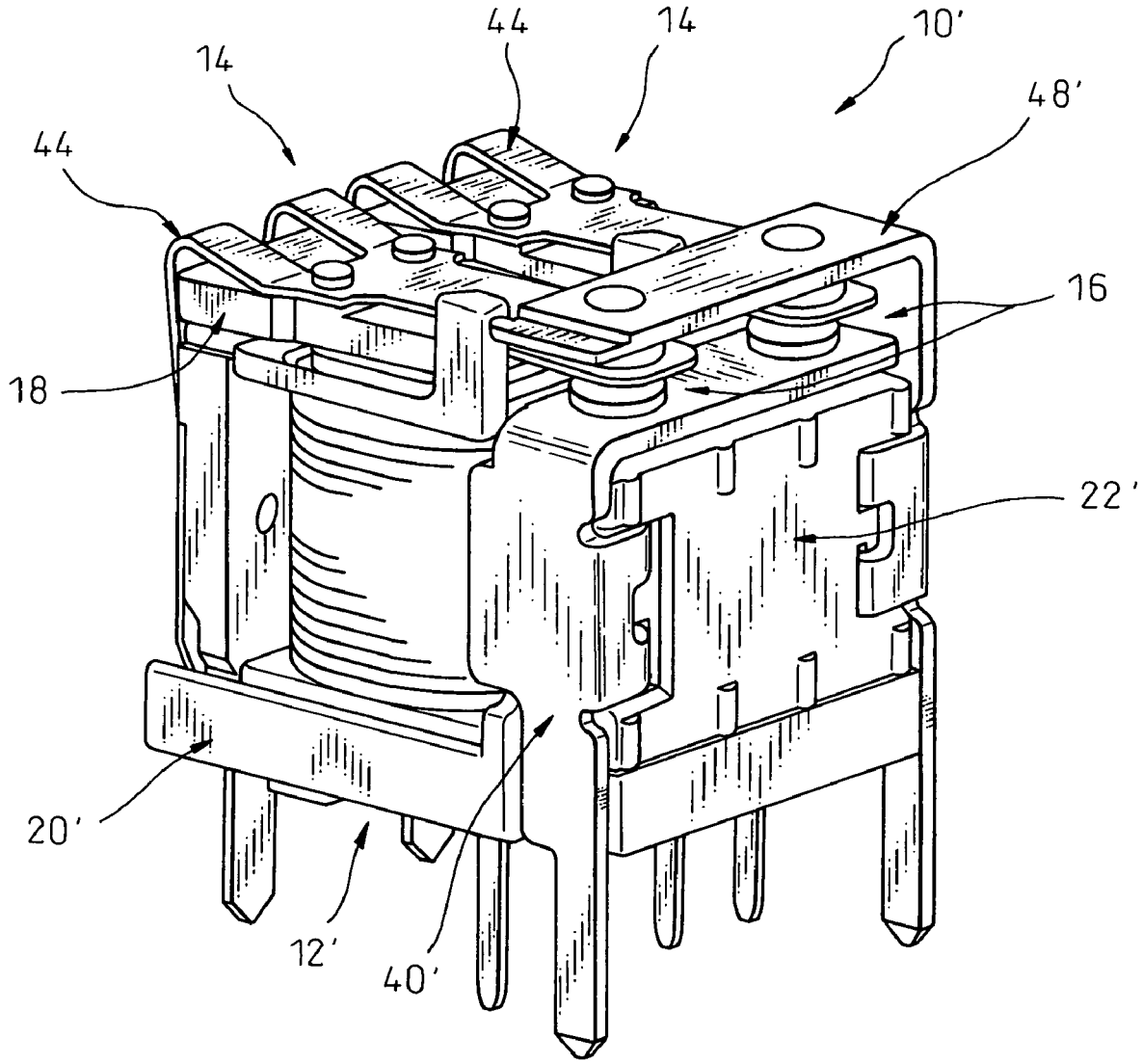
FIG. 11 is a perspective view showing a complex electromagnetic relay, to which the present invention may be applied.
Figure 12:
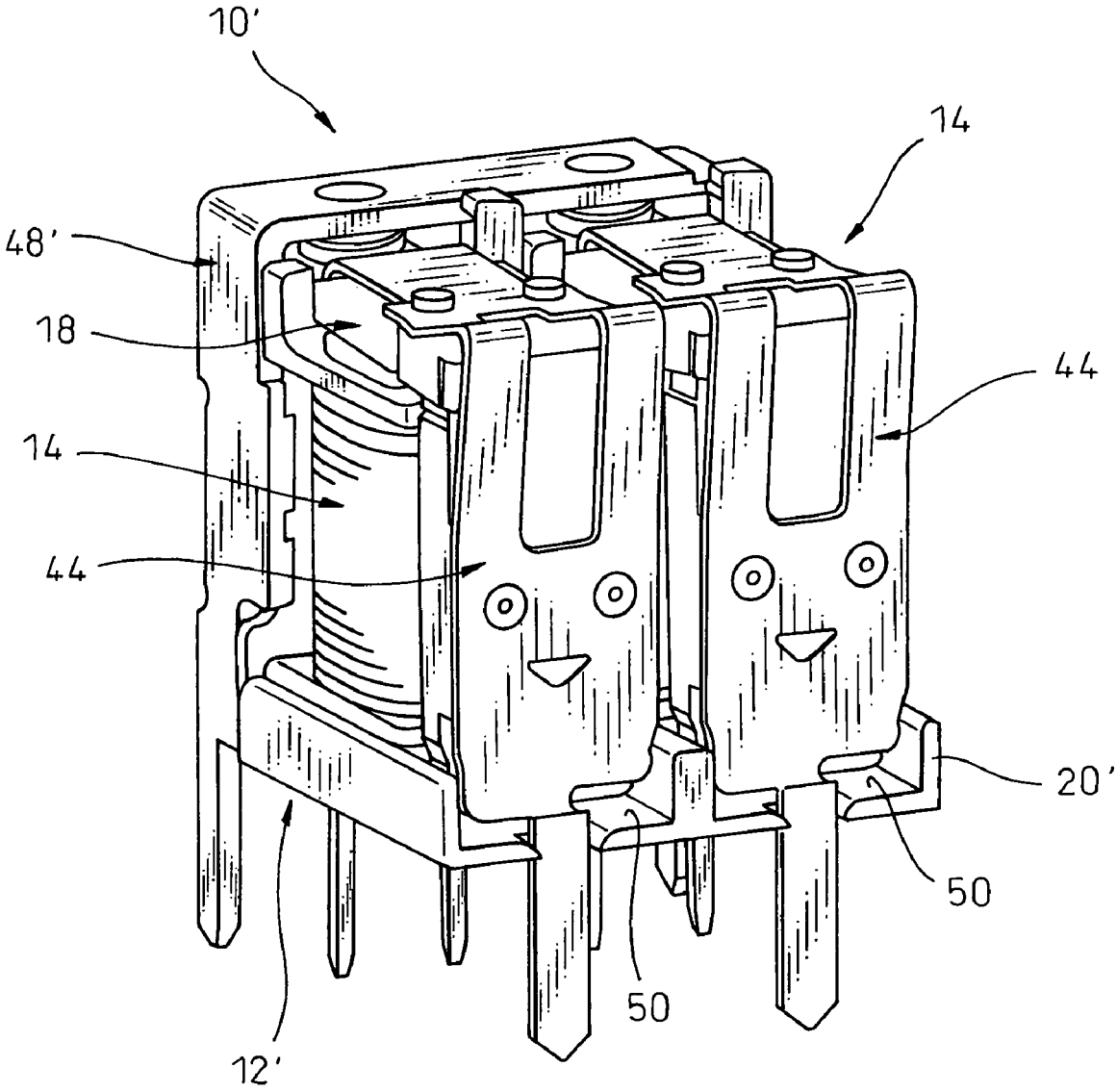
FIG. 12 is a perspective view showing the complex electromagnetic relay of FIG. 11 as shown from the opposite side.

The above-described characteristic configuration of the electromagnetic relay according to the present invention may also be applied to a complex electromagnetic relay in which a plurality of relay structures, each of which includes an electromagnet and a contact section, are mounted on one common base in a parallel arrangement. This type of complex electromagnetic relay may be used in, e.g., a control circuit for operating a motor or a solenoid in a manner frequently switching the operating directions between forward and backward. FIGS. 11 and 12 show a configuration of such a complex electromagnetic relay 10'.

The complex electromagnetic relay 10' is configured by mounting a pair of relay structures, each of which includes the electromagnet 14 and the contact section 16, on one common base 12' in a parallel arrangement. The armature 18 and the movable contact-spring member 44 are attached to the electromagnet 14 of each relay structure, so as to constitute the above-described electromagnet block. Each electromagnet 14 is properly fitted to the base 12' at the fitting position thereon, under the function of the retaining face 50 and the guide face (not shown) provided in the first portion 20' of the base 12'. The first and second stationary contact members 40', 48', provided respectively with two stationary contacts constituting the contact section of each relay structure, are attached to the second portion 22' of the base 12'. In the complex electromagnetic relay 10' having the above configuration, it is also possible to easily and accurately fit or mount each electromagnet 14 to the base 12' at a proper fitting position thereon, while facilitating miniaturization of the relay.

As apparent from the above description, according to the invention, in the action of fitting or mounting the electromagnet to the base, at least one of the yoke and the bobbin of the electromagnet firstly comes into contact with the retaining face of the base, so that the electromagnet is held at a predetermined height on the base. In this first step, it is possible for a worker to recognize a contacting state between the retaining face and at least one of the yoke and the bobbin by feel, without relying on visual inspection. Then, at least one of the yoke and the bobbin is moved along the retaining face, so that at least one of the yoke and the bobbin is slidingly engaged with the guide face of the base and the electromagnet is thus accurately guided in the fitting direction under the function of the guide face. In this second step, it is also possible for the worker to automatically guide the electromagnet into a proper fitting position, merely by shifting the electromagnet in such a manner that at least one of the yoke and bobbin slides along the retaining face, without relying on visual inspection. Therefore, in the inventive electromagnetic relay, even when dimensions of components are reduced to meet a requirement of miniaturization, it is possible to easily and accurately fit or mount the electromagnet to the base at a proper fitting position thereon. Moreover, the inventive electromagnetic relay is configured such that at least one of the yoke and bobbin is inserted between the retaining face and the guide face in a sliding manner, so that the molding dimensional accuracy required for the components is not so strict and, as a result, it is possible to prevent the manufacturing cost from increasing.

Also, according to the preferred embodiment, due to a structural correlation between the lead portion of the coil terminal and the through hole of the base, the electromagnet is fitted to the base in two steps performed in different directions and, in the first step, it is possible to dispose the electromagnet relative to the retaining face at a proper position permitting the subsequent smooth engagement with the guide face. As a result, it is possible to more easily perform the fitting work with significantly high accuracy.

While the invention has been described with reference to predetermined preferred embodiments, it will be understood, by those skilled in the art, that various changes and modifications may be made thereto without departing from the scope of the following claims.

The invention claimed is:

1. An electromagnetic relay comprising:

a base;

an electromagnet fitted to said base; and a contact section fitted to said base and operable to open or close with an operation of said electromagnet;

wherein said electromagnet includes:

a bobbin;

a coil having a center axis and wound and supported on said bobbin;

an iron core incorporated into said bobbin and disposed along said center axis of said coil; and a yoke extending from said iron core to an outside of said bobbin and said coil;

wherein said base includes:

a retaining face firstly contacting with at least one of said yoke and said bobbin, in an action of fitting said electromagnet to said base, and retaining said electromagnet at a predetermined height on said base as seen in a direction of said center axis of said coil; and a guide face slidably engaged with said at least one of said yoke and said bobbin, by shifting said at least one of said yoke and said bobbin along said retaining face, and guiding said electromagnet in a fitting direction intersecting with said center axis;

said retaining face and said guide face cooperating with each other to fixedly support said electromagnet at a predetermined fitting position on said base.

2. An electromagnetic relay as set forth in claim 1, wherein said base is provided with a groove defined between said retaining face and said guide face, said groove straightly extending in said fitting direction and slidably receiving at least one of an outer periphery of said yoke and an outer periphery of said bobbin.

3. An electromagnetic relay as set forth in claim 1, wherein said electromagnet further includes a coil terminal carried on said bobbin, said coil terminal being provided with a lead portion extending generally parallel to said center axis of said coil and projecting outside of said base; and wherein said base includes a through hole receiving said lead portion of said coil terminal, said through hole being shaped to receive said lead portion by shifting said electromagnet relatively to said base in a direction intersecting with said fitting direction and to permit said electromagnet to be shifted in said fitting direction with said lead portion received in said through hole, during said action of fitting said electromagnet to said base.

4. An electromagnetic relay as set forth in claim 1, wherein said electromagnet further includes a coil terminal carried on said bobbin, said coil terminal being provided with a wire-end tying portion extending in a direction intersecting with said center axis of said coil and projecting outside of said bobbin; and wherein said base includes a recess receiving said wire-end tying portion of said coil terminal.

5. An electromagnetic relay as set forth in claim 1, wherein said base includes an abutment face abutted against said bobbin and locating said electromagnet at said fitting position.

6. An electromagnetic relay as set forth in claim 1, further comprising an armature arranged between said electromagnet and said contact section, said armature being driven by said electromagnet and operating said contact section to open or close; wherein said contact section includes a stationary contact member having a stationary contact and fixedly supported on said base and a movable contact-spring member having a movable contact and supported on said yoke, said movable contact-spring member being attached to said armature and elastically displacing said movable contact while accompanying a movement of said armature.

7. An electromagnetic relay as set forth in claim 6, wherein said movable contact-spring member is provided with a first attachment portion defined adjacent to said movable contact and attached to said armature, a second attachment portion extending in a direction intersecting with said first attachment portion and attached to said yoke, an elastic hinge portion extending between said fist attachment portion and said second attachment portion, and a movable-contact lead portion extending from said second attachment portion generally parallel to said center axis of said coil at a side opposite to said elastic hinge portion and projecting outside of said base; and wherein said base is provided with a notch receiving said movable-contact lead portion of said movable contact-spring member and shaped to permit said electromagnet to be shifted in said fitting direction.

8. An electromagnetic relay as set forth in claim 7, further comprising a casing accommodating said electromagnet and said contact section and fitted to said base, said casing being provided with a projection received in said notch of said base at a position adjacent to said movable-contact lead portion of said movable contact-spring member.

9. An electromagnetic relay as set forth in claim 6, wherein said stationary contact member is provided with an attachment portion defined adjacent to said stationary contact and attached to said base and a stationary-contact lead portion extending from said attachment portion generally parallel to said center axis of said coil at a side opposite to said stationary contact and projecting outside of said base, said attachment portion including a main part defined adjacent to said stationary-contact lead portion and a catch defined at a distal end and oppositely spaced from said main part; and wherein said base is provided with a slit receiving said catch of said stationary contact member in a press-fit manner and a rib formed locally on an outer face of an outer wall defining said slits to be abutted against said main part of said stationary contact member under pressure.

10. An electromagnetic relay as set forth in claim 9, wherein said stationary contact member is further provided with an auxiliary attachment portion defined adjacent to said stationary contact at a position away from said attachment portion and attached to said bobbin.

11. An electromagnetic relay as set forth in claim 6, wherein a position of said stationary contact and a position of an end face of said iron core, opposing to said armature, are determined with reference to said retaining face of said base.

12. An electromagnetic relay as set forth in claim 6, wherein said stationary contact member is attached to said base by insert molding.

* * * * *